US007746277B2

(12) United States Patent
Huang et al.

(10) Patent No.: US 7,746,277 B2
(45) Date of Patent: Jun. 29, 2010

(54) PLANE SUPER WIDE BAND COUPLING ANTENNA

(75) Inventors: Ching-Hsiung Huang, Taipei County (TW); Ming-Han Perng, Taipei County (TW); Chung-Ming Lin, Taipei County (TW); Chia-Cheng Lo, Taipei County (TW); Ming-Lai Chen, Taipei County (TW)

(73) Assignee: Joinsoon Electronic Mfg Co. Ltd., Xizhi, Taipei Country (TW)

( * ) Notice: Subject to any disclaimer, the term of this patent is extended or adjusted under 35 U.S.C. 154(b) by 117 days.

(21) Appl. No.: 12/054,386

(22) Filed: Mar. 25, 2008

(65) Prior Publication Data

US 2009/0243935 A1 Oct. 1, 2009

(51) Int. Cl.
*H01Q 1/38* (2006.01)

(52) U.S. Cl. ..... 343/700 MS

(58) Field of Classification Search ..... 343/700 MS, 343/702

See application file for complete search history.

(56) References Cited

U.S. PATENT DOCUMENTS 7,425,924 B2 * 9/2008 Chung et al. ..... 343/702

* cited by examiner

*Primary Examiner*—Hoang V Nguyen

(57) ABSTRACT

A plane super wide band coupling antenna comprises an isolating substrate for installing with a metal thin film layer by printing; a first radiating portion being a metal thin film layer printed upon the isolating substrate; the first radiating portion having a coupling section and being extended with a feeding point; a second radiating portion being a metal thin film layer printed upon the isolating substrate; the second radiating portion extending from a ground portion on the isolating substrate and being a bended structure; the second radiating portion being formed with gaps with the first radiating portion; the ground portion being formed by a metal thin film layer; one end thereof being electrically connected to the second radiating portion; a signal feeding wire being a coaxial cable; and the main signal wire of the signal feeding wire being electrically connected to the feeding point of the first radiating portion.

5 Claims, 4 Drawing Sheets

PLANE SUPER WIDE BAND COUPLING ANTENNA

FIELD OF THE INVENTION

The present invention relates to antennas, and particularly to a plane super wide band coupling antenna, in that in a plane, an inverse F antenna is coupled to a single pole antenna which has dual frequencies and has a small volume so as to be used in a wireless network; by the coupling effect, the antenna of the present invention has a frequency response with a super wide band from 2 to 6 GHz.

BACKGROUND OF THE INVENTION

There are four standards for wireless local area network, including IEEE802.11, IEEE802.11b; Bluetooth suitable for the frequency band of 2.4 GHz and IEEE802.11a suitable for 5 GHz. When a wireless application electronic device is used for different standards so that a plurality of frequency bands are necessary, the corresponding antenna is used.

Referring to FIG. 1, a perspective view of a prior art dual frequency antennal is illustrated, which is an inverse dual frequency antenna for receiving a first frequency and a second frequency. The antenna 100 has a first plane trans-conductive element 200 and a second plane trans-conductive element 300. The first plane trans-conductive element 200 has an L shape and second plane trans-conductive element 300 has a bended rectangular structure which is vertical to the first plane trans-conductive element 200 and is connected to a joint 400 of the first plane trans-conductive element 200. When the area of the second plane trans-conductive element 300 is overlarge, it will induce the joint to break. However the bandwidth, impedance matching and gain of the antenna 100 are adjustable by the first plane trans-conductive element 200 and the second plane trans-conductive element 300. The area of the second plane trans-conductive element 300 will affect the gain of the antenna. If an antenna with a higher bandwidth is needed, the area of the substrate is needed to be enlarged, which is confined by the installing space. Thus the area of the substrate can not be enlarged effectively.

Therefore, from above description, it is known that the prior art has the following defects.

The prior art is confined by space and thus the bandwidth is confined.

In the prior art, when the second plane trans-conductive element has an overlarge area, it will induce that the joint between the two trans-conductive elements breaks.

In using the prior art, the ability for sensing the harmonics is insufficient and the standing wave ratio is low and thus it will induce the difficulty in the design of the circuit.

The manufacturing process in the prior art is tedious, the cost is high and the installation is difficult.

SUMMARY OF THE INVENTION

The object of the present invention is to provide a plane super wide band coupling antenna, in that in a plane, an inverse F antenna is coupled to a single pole antenna which has dual frequencies and has a small volume so as to be used in a wireless network; by the coupling effect, the antenna of the present invention has a frequency response with a super wide band from 2 to 6 GHz.

Moreover, the present invention provide a plane super wide band coupling antenna, which has lower cost, the manufacturing process and installation work are easy. The present invention has low profile and is light weighted.

Moreover, the present invention has small volume and is suitable for various electronic or communication devices.

Further, the present invention provides a plane super wide band coupling antenna which is dual frequencies and has a wide bandwidth as a coupling antenna with a higher radiation efficiency, low feeding lose and reflection lose.

To achieve above object, the present invention provides a plane super wide band coupling antenna comprising: an isolating substrate for installing with a metal thin film layer by printing; a first radiating portion being a metal thin film layer printed upon the isolating substrate; the first radiating portion having a coupling section which is energy-coupled to the second radiating portion; the first radiating portion being extended with a feeding point which is electrically connected to a signal feeding wire; a second radiating portion being a metal thin film layer printed upon the isolating substrate; the second radiating portion extending from a ground portion on the isolating substrate and being a bended structure; one free end of the second radiating portion being formed with gaps with the coupling section of the first radiating portion for electric isolation so as to have an optimum frequency response for energy induction; and the ground portion being formed by a metal thin film layer which is an electric conductor; one end thereof being electrically connected to the second radiating portion, the ground portion having the same potential as an grounding end of a main signal wire; and a signal feeding wire being a coaxial cable; the main signal wire of the signal feeding wire being electrically connected to the feeding point of the first radiating portion; a grounding wire of the signal feeding wire being electrically thereof to the ground portion for transferring signals to a signal receiving/transmitting circuit.

A length from the feeding point of the first radiating portion to a free end of the first radiating portion is one fourth (¼) of a wavelength of the frequency response.

The radiation frequency band of the first radiating portion is 2.0 GHz.

A length of the second radiating portion is one fourth (¼) of a wavelength of the frequency response.

The radiation frequency band of the second radiating portion is 6.0 GHz.

Therefore, the present invention has a lower cost, and the manufacturing process and installation work are easy. The present invention has low profile and is light. Moreover, the present invention has small volume and is suitable for various electronic or communication devices.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
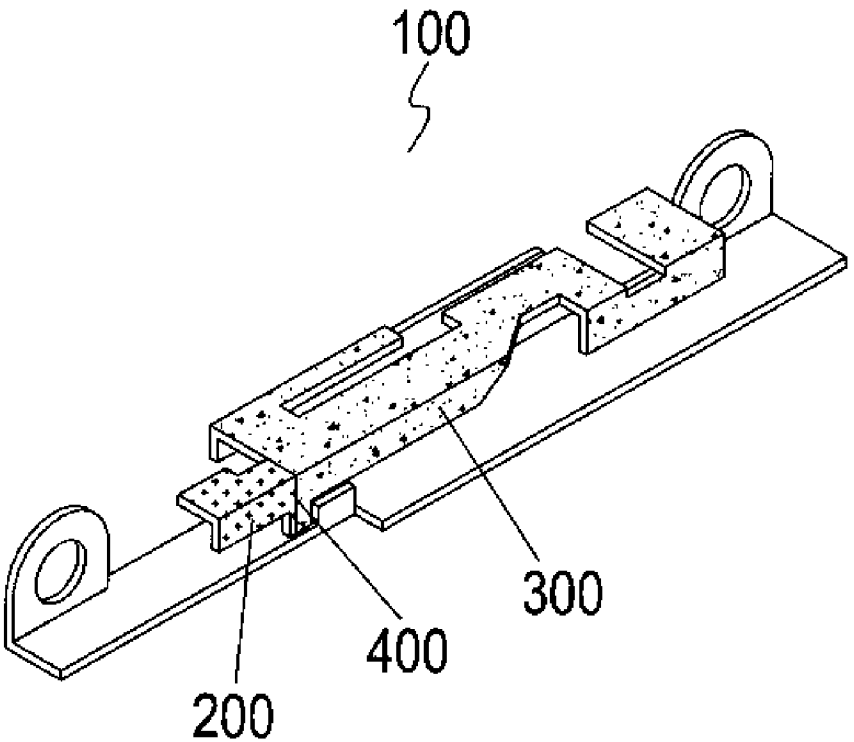
FIG. 1 is a perspective view of a prior art dual frequency antenna.
Figure 2:
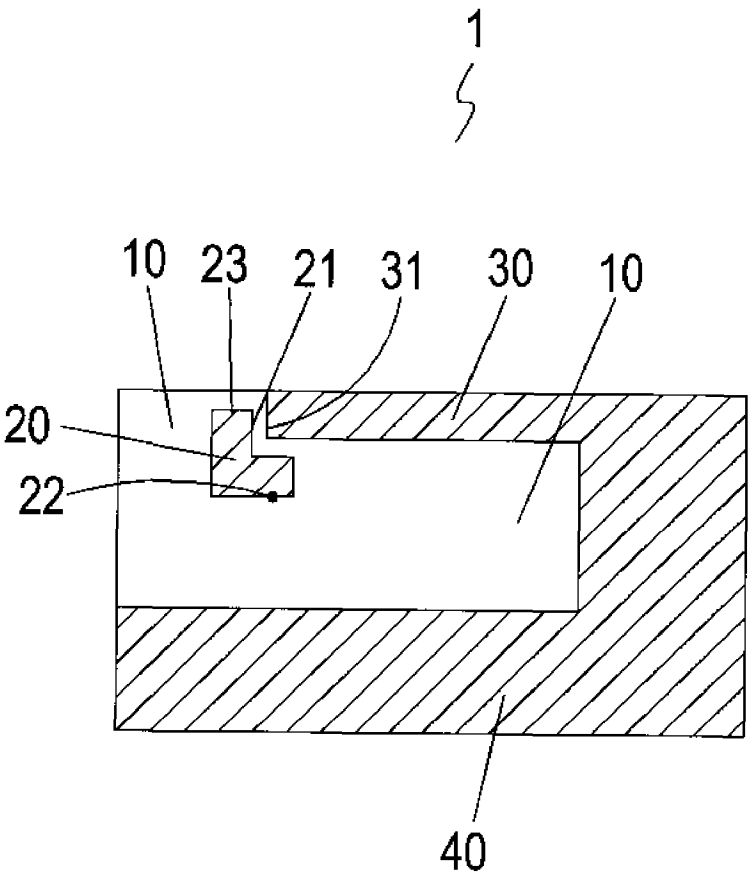
FIG. 2 is a plane view of the present invention.
Figure 3:
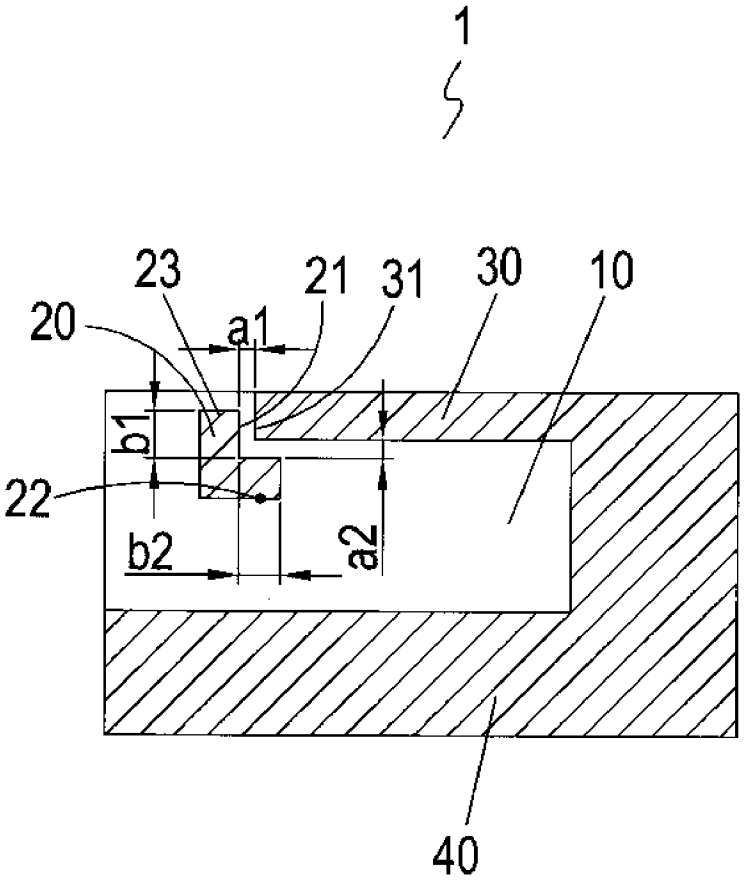
FIG. 3 is a schematic view showing the coupling section of the present invention.
Figure 4:
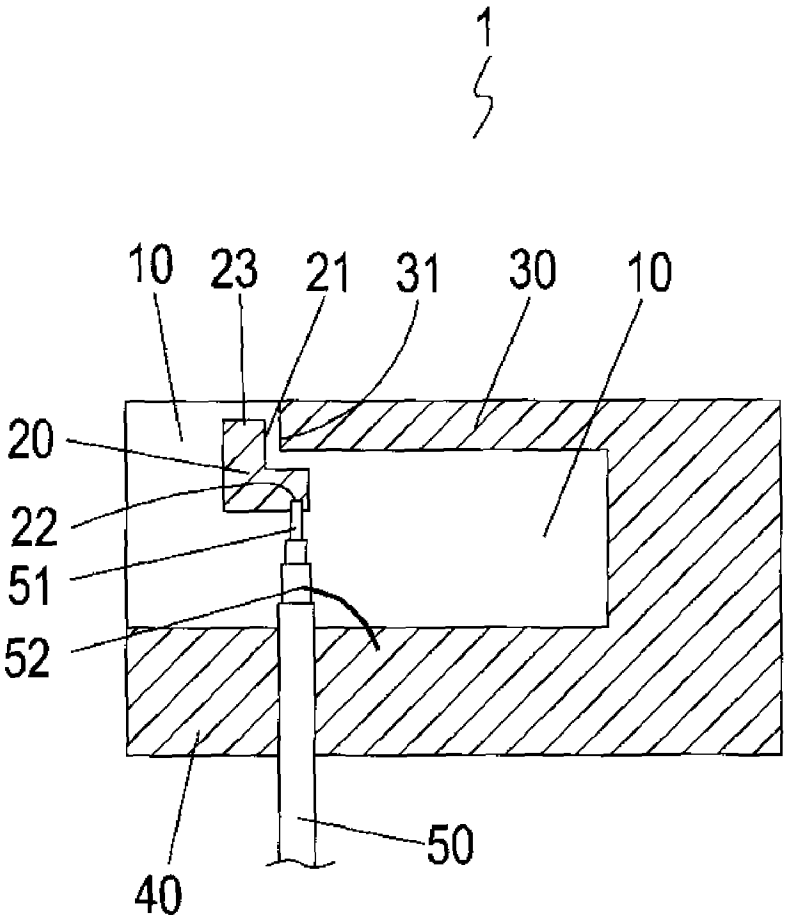
FIG. 4 shows the application of the present invention.

Referring to FIGS. 2 to 4, the structure of the present invention is illustrated. The plane super wide band coupling antenna 1 of the present invention has the following elements.

An isolating substrate 10 is for printing to have a metal thin film layer.

A first radiating portion 20 is a metal thin film layer which is printed upon the isolating substrate 10. The first radiating portion 20 is installed with a coupling section 21 which can be coupled with the second radiating portion 30 in energy. A feeding point 22 extends from a lower edge of the first radiating portion 20. The feeding point 22 is electrically connected to a signal feeding wire 50. An upper side of the first radiating portion 20 has a free end 23. A length from the feeding point 22 to the free end 23 is one fourth (¼) of the wavelength in frequency response. The radiation frequency band of the first radiating portion 20 is 2.0 Ghz.

The second radiating portion 30 is a metal thin film layer which is printed upon the isolating substrate 10. The second radiating portion 30 extends from a ground portion 40 on the isolating substrate 10 and has a bend structure. A left side of the second radiating portion 30 is formed as a free end 31. A left side of the free end 31 has a distance a1 to a right side of the free end 23 and a lower side of the free end 31 is a distance a2 to an upper side of a horizontal portion of the first radiating portion 20 for having an optimum frequency response so as to have the effect of energy coupling. A total length of the second radiating portion 30 is about one fourth of the wavelength of the frequency response. The radiation frequency band is 6.0 Ghz for the second radiating portion 30.

A ground portion 40 is made of electric conductive metal thin film layer. One end thereof is electrically connected to the second radiating portion 30 and the ground portion 40 has the same potential as the ground end of the antenna receiver.

A signal feeding wire 50 is a coaxial cable and the main signal wire 51 thereof is electrically connected to the feeding point 22 of the first radiating portion 20 and the ground wire 52 is electrically connected to the ground portion 40 for transmitting signals to the signal receiving/transmitting circuit.

Referring to FIG. 3, it is illustrated that electric insulating gaps a1, a2 are formed between the second radiating portion 30 and the first radiating portion 20. The widths of the second radiating portion 30 corresponding to the gaps a1, a2 are adjustable to have an optimum frequency response for energy coupling.

Advantages of the present invention are that the present invention has a lower cost, the manufacturing process and installation work are easy. The present invention has low profile and is light weighted. Moreover, the present invention has small volume and is suitable for various electronic or communication devices.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A plane super wide band coupling antenna comprising:

an isolating substrate (10) for installing with a metal thin film layer by printing;

a first radiating portion (20) being a metal thin film layer printed upon the isolating substrate (10); the first radiating portion (10) having an approximate L shape formed by two approximate rectangular sheets which are approximately vertical to one another; one side of one of the rectangular sheet of the first radiating portion (20) being formed as a coupling section (21); the coupling section (21) being energy-coupled to a second radiating portion (30); the first radiating portion (20) being extended with a feeding point (22) which is electrically connected to a signal feeding wire (50);

the second radiating portion (30) being a metal thin film layer printed upon the isolating substrate (10); extending from a ground portion (40) on the isolating substrate (10) and having an approximate L shape, one first section of the L shape being an approximate rectangular shape; the first section of the second radiating portion (30) being formed as a free end; gaps between the two sheets of the first radiating portion (20) and two sides of the free end (31) of the second radiating portion (30) being formed as an L shape space; the gaps being formed as the coupling section between the first and second radiating portions for electric isolation so as to have an optimum frequency response for energy induction;

the ground portion (40) being formed by a metal thin film layer which is an electric conductor; one end thereof being electrically connected to the second radiating portion; the ground portion having the same potential as an grounding end of a main signal wire;

the signal feeding wire (50) being a coaxial cable; the main signal wire (51) of the signal feeding wire (50) being electrically connected to the feeding point of the first radiating portion; a grounding wire (52) of the signal feeding wire being electrically connected to the ground portion for transferring signals to a signal receiving/transmitting circuit.

2. The plane super wide band coupling antenna as claimed in claim 1, wherein a length from the feeding point of the first radiating portion to a free end of the first radiating portion is one fourth (¼) of a wavelength of the frequency response.

3. The plane super wide band coupling antenna as claimed in claim 1, wherein the radiation frequency band of the first radiating portion is 2.0 GHz.

4. The plane super wide band coupling antenna as claimed in claim 1, wherein a length of the second radiating portion is one fourth (¼) of a wavelength of the frequency response.

5. The plane super wide band coupling antenna as claimed in claim 1, wherein the radiation frequency band of the second radiating portion is 6.0 GHz.

* * * * *